United States Patent [19]

Wilkin

[11] Patent Number: 4,998,953

[45] Date of Patent: Mar. 12, 1991

[54] LOCK WITH AN EXTERNALLY MOUNTABLE ESCUTCHEON

[75] Inventor: Clive J. Wilkin, Crewe, England

[73] Assignee: Rolls-Royce Motor Cars Limited, Cheshire, England

[21] Appl. No.: 419,261

[22] Filed: Oct. 10, 1989

[30] Foreign Application Priority Data

Oct. 14, 1988 [GB] United Kingdom ..... 8824123

[51] Int. Cl.[5] ..... E05B 15/02

[52] U.S. Cl. ..... 70/452; 70/381

[58] Field of Search ..... 70/452, 451, 381; 292/357, 348, 353

[56] References Cited

U.S. PATENT DOCUMENTS

| | | | |
|---|---|---|---|
| 323,393 | 8/1885 | Bullard | 70/452 |
| 3,455,129 | 7/1969 | Forbes | 70/452 |
| 4,489,577 | 12/1984 | Crepinsek | 70/452 |

*Primary Examiner*—Robert L. Wolfe

*Attorney, Agent, or Firm*—Cushman, Darby & Cushman

[57] ABSTRACT

A lock assembly for an automobile door comprises a lock mechanism, arranged to be offered up and connected to the door from the inside and an escutcheon arranged to be offered up to the door from the outside and to be fixed to the lock mechanism by means of a U-shaped clip, access to which is subsequently prevented by the installation of the door handle. This facilitates the production process, as it enables the finishing step of applying the escutcheon to be delayed.

12 Claims, 4 Drawing Sheets

LOCK WITH AN EXTERNALLY MOUNTABLE ESCUTCHEON

The present invention relates to a lock assembly particularly, but not exclusively for an automobile door.

At present such locks are usually placed on the outside surface of the door and fixed from the inside. Any paint finishing work on the door must be carried out prior to fixing the lock, that is with the door in the stripped down condition. If paint work on the car has been damaged or requires rectification at the final assembly stage (or earlier in its build) then sometimes locks and door handles need to be removed to allow unrestricted access for spraying and polishing. This entails removal of door trim pads and disturbing any mechanical or electrical controls on the door handle and lock fixings. This is a tedious and expensive process which slows down production and can threaten build quality already achieved in earlier production stages.

According to the present invention, there is provided a lock assembly comprising a lock mechanism, an escutcheon adapted to be releasably fixed to the mechanism and a member operative to releasably fix the escutcheon to the mechanism.

In a preferred embodiment of the invention, the member comprises a clip which is adapted to locate in a complementary groove in the escutcheon to provide the releasable fixing. The clip is spring loaded and may be expanded against the spring force to enable release and allowed to contract to provide the connection. The clip is U-shaped and the legs of the U extend through slots or apertures in the housing of the mechanism to engage the groove in part of the escutcheon which extends into the housing. The spring is a tension spring and extends between the free ends of the legs of the U-shaped clip. In use, for example, on an automobile door, the clip is accessible from outside the door through an aperture in the door displaced from that in which the lock is located. Thus the main part of the lock assembly can be assembled from inside the door and the escutcheon releasably fixed to it later from outside the door thus permitting paint rectification processes to be undertaken before the escutcheon is connected but after the lock is mounted without stripping down the inside of the door. Once the escutcheon is in position, the aperture in the door allowing access to the clip can be closed over for example with the door handle.

In order that the invention may be more clearly understood, one embodiment thereof will now be described, by way of example, with reference to the accompanying drawings, in which.

Figure 1:
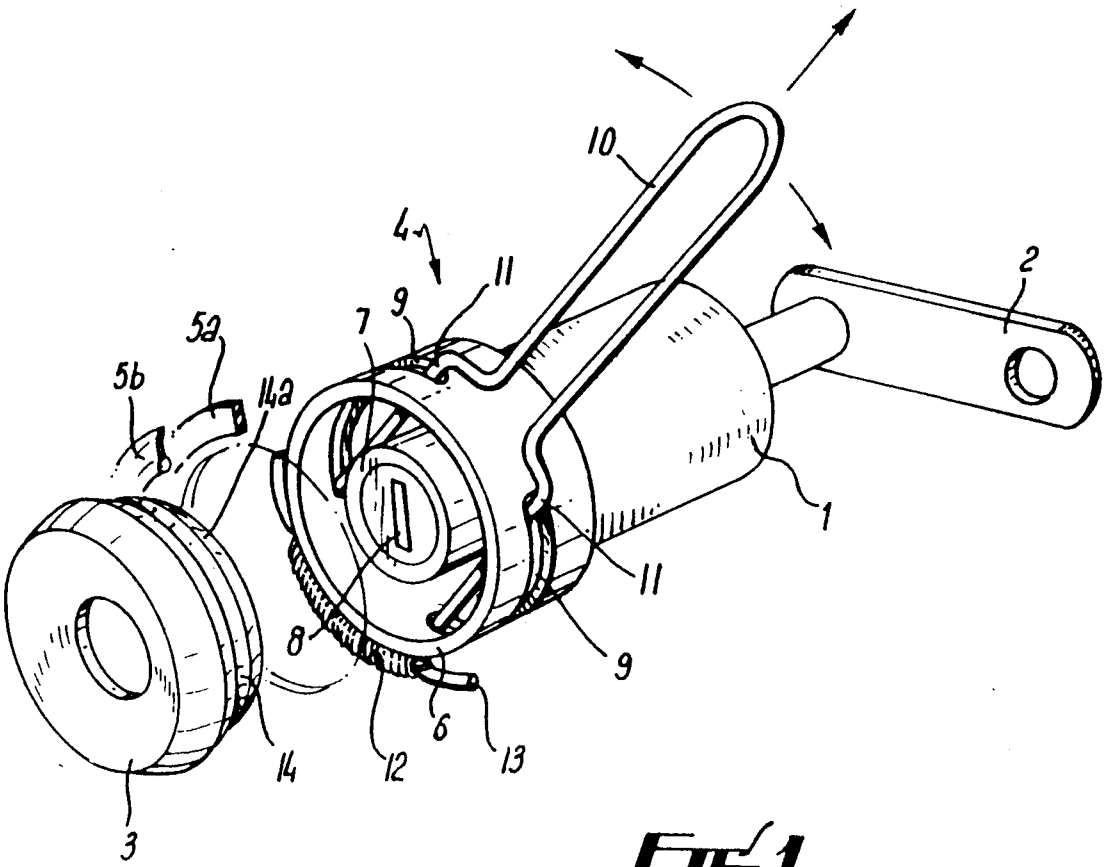
FIG. 1 shows an exploded perspective view of a lock assembly for an automobile door.
Figure 2:
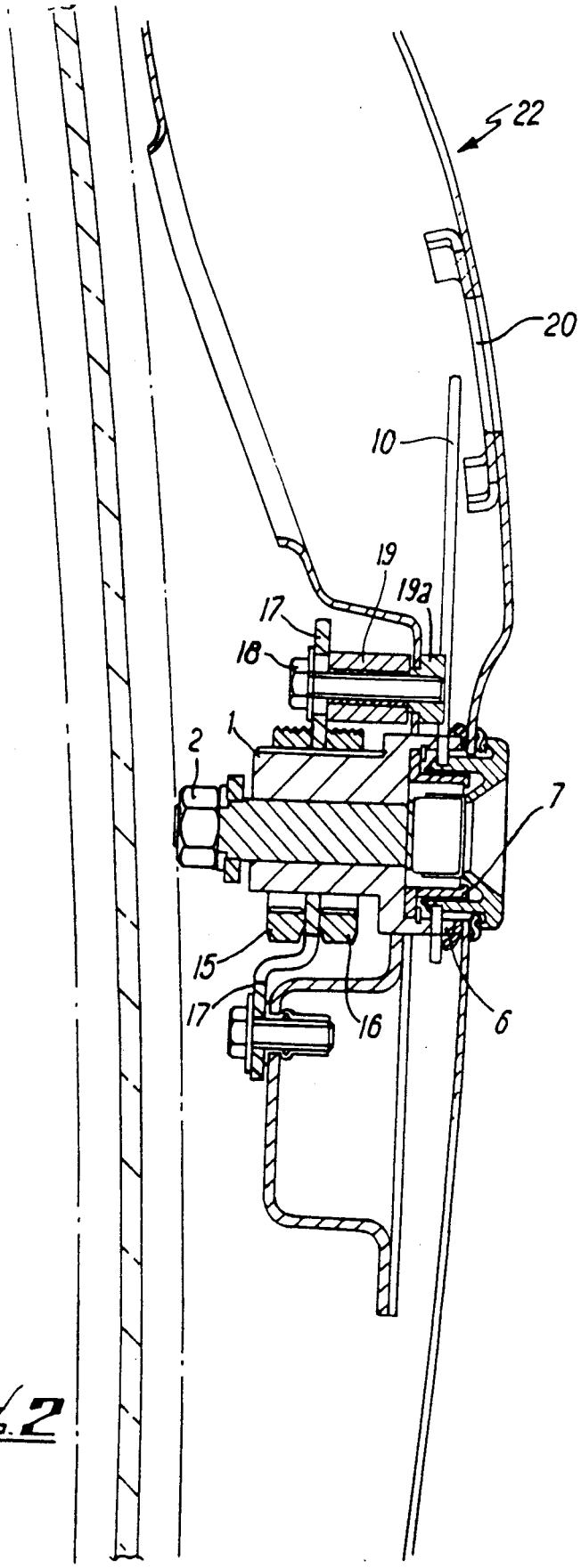
FIG. 2 shows a cross-section through a door with the lock assembly of FIG. 1 locked in position.

Referring to FIG. 1, the lock assembly comprises a lock barrel 1, an operating lever 2, an escutcheon 3, an escutcheon retaining arrangement 4 and internal and external seals 5*a* and 5*b*. The lock barrel 1 terminates in an annular extension 6 which coaxially surrounds a boss 7 which defines the keyhole 8. The annular extension defines two arcuate circumferential apertures 9 disposed on diametrically opposite sides thereof. An elongate generally U-shaped clip 10 is disposed with opposite legs 11 of the U located in respective apertures so that they extend through the extension 6. These legs 11 are urged together and into the apertures 9 by means of a tension spring 12 disposed between turned back portions 13 at the free ends of the legs of the U.

The escutcheon 3 carries a grooved boss 14 on its underside and the legs 11 extend through the apertures into the groove to lock the escutcheon in position. The boss has a chamfered nose 14*a*. The seals 5*a* and 5*b* are made of a resilient material such as natural or synthetic rubber. The escutcheon 3 may be released from the lock barrel by rotating the clip 10 in either direction about the axis of the barrel or pulling the clip 10 in a direction at right angles to the axis. These three directions are indicated by arrows in FIG. 1. Any of these actions will result in the withdrawal of the legs 11 from the groove 14 which in turn will enable the escutcheon to be withdrawn.

Figure 3:
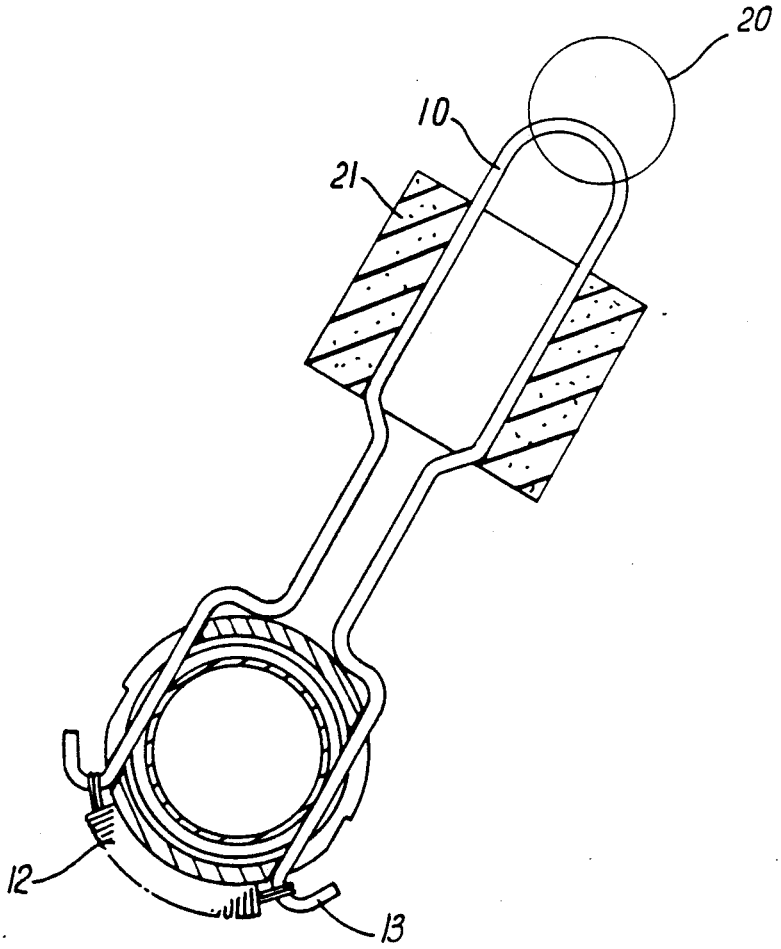
FIG. 3 shows a vertical section through the lock assembly of FIG. 1.
Figure 4:
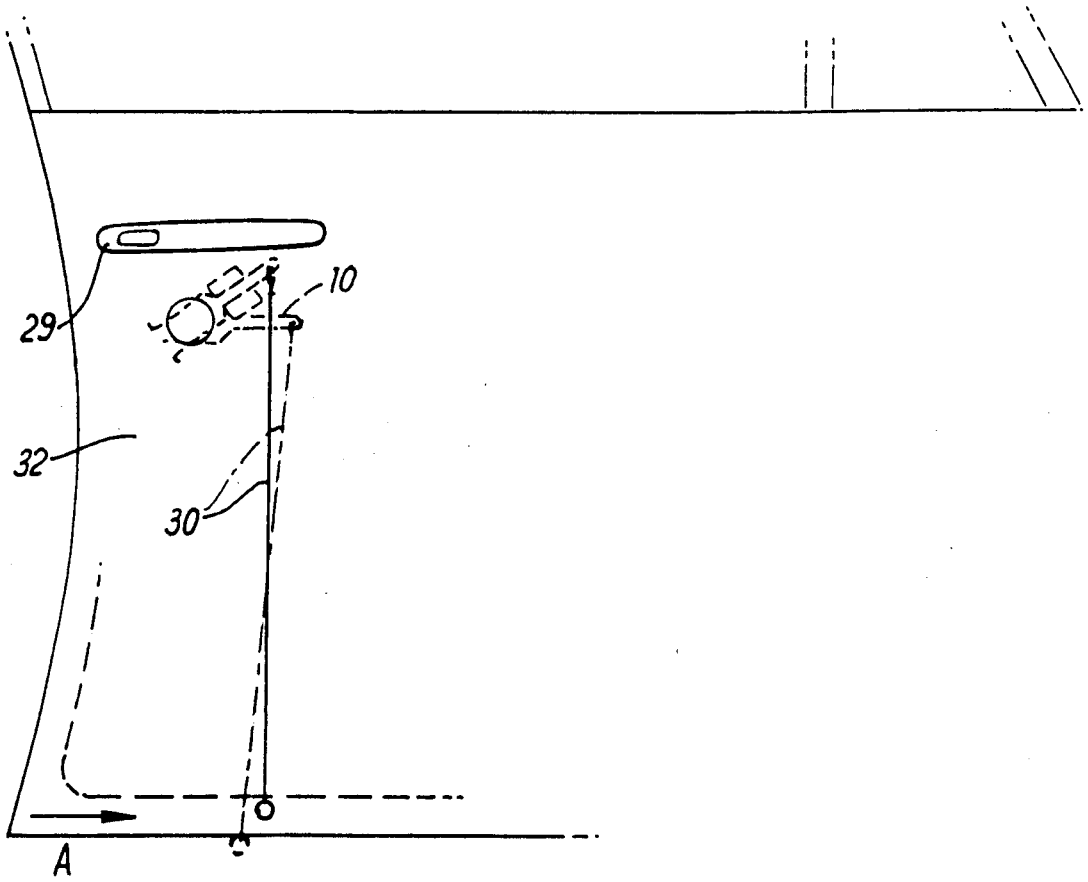
FIG. 4 is a side elevational view showing some hidden detail of an alternative embodiment.
Figure 5:
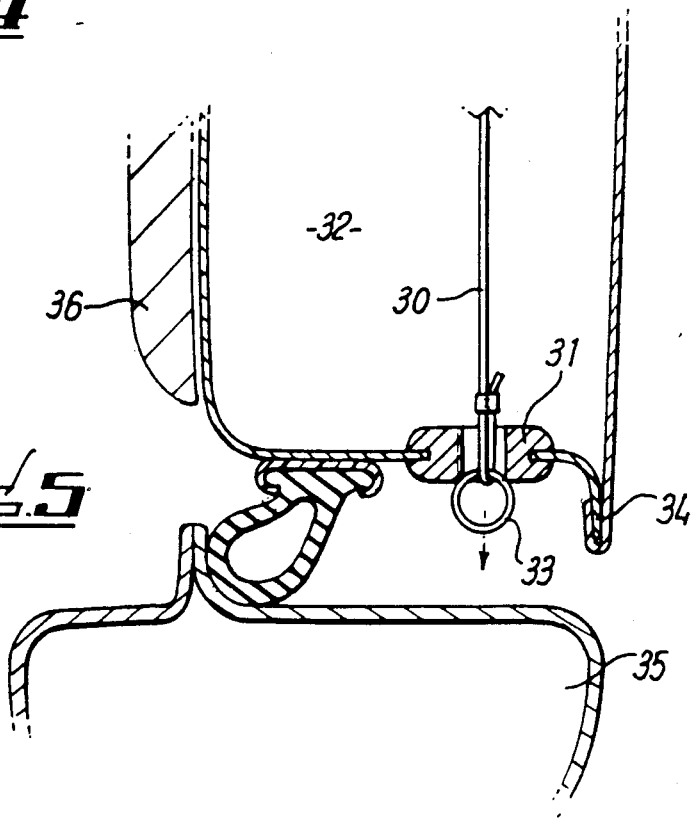
FIG. 5 is a cross-sectional view taken in the direction of the arrow A on FIG. 4.

To mount the lock assembly in the automobile door 22, it is offered up inside the door from the inside, that is before the trim has been fitted to the door. The assembly is fixed in position by locknuts 15 and 16 threaded on the externally screwthreaded lock barrel 1 on opposite sides respectively of a bracket 17 which forms part of the internal structure of the door. A bolt 18 extending through this bracket 17 into a spacer 19, and into an internally threaded fixed boss 19*a* completes the fixing. By positioning the locknuts 15 and 16 appropriately, the position of the boss 7 may be precisely positioned to achieve correct compression of the internal seal. The clip 10 is accessible through the aperture 20 provided for the door handle. Any necessary paint rectification processes may be carried out at this stage. Thereafter the lock assembly may be completed by introducing the escutcheon 3 with surrounding seal 5*b* to the remainder of the assembly and connecting it to the remainder by moving the clip 10 in one of the three directions previously described and then releasing it or by simply pushing it into place. This automatic retention is achieved by the chamfered nose of escutcheon which upon entering the annular extension 6 spreads the legs 11 apart and at the correct position they click into the escutcheon groove 14. The handle may then be fixed onto the door, closing off access to the clip 10. Within the door, the clip 10 is disposed in a piece of foam 21 (see FIG. 3) to prevent it from rattling. When the escutcheon is connected to the remainder of the assembly, the seal 5 is compressed against the surface of the door, taking up any variations in that surface.

Where access to the clip 10 from exterior of the door, which in the case described above is through the aperture 20 provided for the door handle 29, is either difficult or impossible, a remote release may be provided. Such an arrangement is illustrated in FIGS. 4 and 5. This comprises a cord or cable 30 attached at one end to the base of the 'U' of the clip 10 and extending through a grommet 31 disposed in an aperture in the base of the corresponding door 32. A pull ring 33 is connected to the other end of the cord adjacent the grommet. In this position, the ring is shielded by the lip 34 of the door and for security reasons would not normally be accessible between the door 32 and the doorsill 35 when the door is closed. To release the escutcheon 3, the door is opened and the ring pulled downwardly to rotate the clip 10. (This position is shown in dashed line in FIG. 4).

The arrangement could be made even more secure by bringing the cord out through an aperture in the door trim 36 so that the pullring 33 is located inside the vehicle. In another alternative form, where access to the clip 10 from externally of the door is either impossible or difficult, an access hole available only when the door is open may be provided and a hooked tool designed to manipulate the clip 10 through the hole supplied.

It will be appreciated that the above embodiment has been described by way of example only and that many variations are possible without departing from the invention.

I claim:

1. A lock assembly comprising a lock mechanism, an escutcheon adapted to be releasably fixed to the mechanism and a member operative to releasably fix the escutcheon to the mechanism, the escutcheon and mechanism being formed such that the escutcheon can be pushed onto the mechanism to achieve the releasable fixing.

2. A lock assembly comprising a lock mechanism, an escutcheon adapted to be releasably fixed to the mechanism and a member operative to releasably fix the escutcheon to the mechanism, said member comprising a clip which is adapted to locate in a complementary groove in the escutcheon to provide the releasable fixing.

3. A lock assembly as claimed in claim 2, in which the clip is spring loaded and may be expanded against the spring force to enable release and allowed to contract to provide the connection.

4. A lock assembly as claimed in claim 2, in which the clip is U-shaped and the legs of the U extend through slots or apertures in the housing of the mechanism to engage the groove in part of the escutcheon which extends into the housing.

5. A lock assembly as claimed in claim 4, in which the spring loading is provided by a tension spring extending between the free ends of the legs of the U.

6. A lock assembly as claimed in claim 4, in which the escutcheon has a chamfered nose which in operation acts to displace the legs of the U.

7. A door comprising a lock assembly as claimed in claim 1, in which the lock mechanism is disposed in the inside of the door and the escutcheon to the outside but extending through an aperture in the door into the lock mechanism and the member for releasably fixing the escutcheon and mechanism together is accessible through another aperture in the door.

8. A door as claimed in claim 7, in which the other aperture in the door serves to receive a door handle whereby access to the member is prevented.

9. A door as claimed in claim 7, in which the lock assembly is externally screwthreaded and is fixed in the desired position relative to the door by means of locknuts and screwed onto the screwthreaded exterior on opposite sides respectively of a bracket forming part of the internal structure of the door.

10. A door as claimed in claim 7, in which internal and external seals surround the escutcheon on opposite sides respectively of the door and are urged against the door when the escutcheon and lock mechanism are fixed together.

11. A door comprising a lock assembly as claimed in claim 1, in which the lock mechanism is disposed in the inside of the door and the escutcheon to the outside, but extending through an aperture in the door into the lock mechanism, and release means accessible from externally of the door for releasing the member operative to fix the escutcheon and member together.

12. A door comprising a lock assembly as claimed in claim 11, in which the release means comprises an elongate element extending from the member to the external surface of the door.

* * * * *